US007967402B2

(12) United States Patent
Hoshide et al.

(10) Patent No.: US 7,967,402 B2
(45) Date of Patent: Jun. 28, 2011

(54) SLIDE RAIL UNIT WITH RETAINING FUNCTION

(75) Inventors: Kaoru Hoshide, Tokyo (JP); Akira Sato, Tokyo (JP); Soichi Sasaki, Tokyo (JP)

(73) Assignee: THK Co., Ltd., Tokyo (JP)

( * ) Notice: Subject to any disclaimer, the term of this patent is extended or adjusted under 35 U.S.C. 154(b) by 843 days.

(21) Appl. No.: 11/632,145

(22) PCT Filed: Mar. 30, 2006

(86) PCT No.: PCT/JP2006/306680
§ 371 (c)(1),
(2), (4) Date: Jan. 7, 2008

(87) PCT Pub. No.: WO2006/109579
PCT Pub. Date: Oct. 19, 2006

(65) Prior Publication Data

US 2008/0231156 A1 Sep. 25, 2008

(30) Foreign Application Priority Data

Apr. 28, 2005 (JP) ..... 2005-133399

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.44, 319.1, 312/402, 404; 384/20, 21
See application file for complete search history.

(56) References Cited

U.S. PATENT DOCUMENTS 5,207,781 A 5/1993 Röch
5,364,179 A * 11/1994 Brustle et al. ..... 312/333
5,580,138 A * 12/1996 Grabher ..... 312/319.1
6,499,818 B2 12/2002 Brüstle
7,028,370 B2 * 4/2006 Hoshide et al. ..... 16/96 R
(Continued)

FOREIGN PATENT DOCUMENTS

JP 2-286102 A 11/1990
(Continued)

OTHER PUBLICATIONS

International Search Report of PCT/JP2006/306680, date of mailing Jul. 11, 2006.

*Primary Examiner* — James O Hansen
(74) *Attorney, Agent, or Firm* — Westerman, Hattori, Daniels & Adrian, LLP

(57) ABSTRACT

Provided is a slide rail unit which, when accommodating a second rail (2) in a first rail (1), can automatically draw in the second rail to an end position and retain it at that position and which can be produced easily with a small number of parts and at low cost, the slide rail unit being equipped with a retaining pin (30) provided upright so as to be movable with respect to the first rail (1) in the longitudinal direction and the width direction thereof, an elastic member (31) for urging the retaining pin (30) toward the stroke end of the second rail (2), a pin guide member (32) provided on the first rail (1) and adapted to lock the retaining pin (30) at a standby position spaced apart from the stroke end against an urging force of the elastic member (31) and to guide the retaining pin (30) detached from the standby position toward the stroke end with the urging force, and a cam member (33) provided on the second rail (2) and adapted to detach the retaining pin (30) from the standby position of the pin guide member (32) and lock the retaining pin as it overlaps the pin guide member (32).

5 Claims, 11 Drawing Sheets

U.S. PATENT DOCUMENTS

| | | | | |
|---|---|---|---|---|
| 2004/0056573 | A1* | 3/2004 | Chae | 312/404 |
| 2004/0237252 | A1 | 12/2004 | Hoshide et al. | |
| 2005/0104492 | A1* | 5/2005 | Chiu | 312/333 |

FOREIGN PATENT DOCUMENTS

| | | | |
|---|---|---|---|
| JP | 6-245830 | A | 9/1994 |
| JP | 11-201158 | A | 7/1999 |
| JP | 11-206489 | A | 8/1999 |
| JP | 2001-245738 | A | 9/2001 |
| JP | 3100774 | U | 5/2004 |
| JP | 3105443 | U | 10/2004 |
| JP | 2004-344188 | A | 12/2004 |
| JP | 2005-34348 | A | 2/2005 |
| JP | 2006-42971 | A | 2/2006 |

* cited by examiner

SLIDE RAIL UNIT WITH RETAINING FUNCTION

TECHNICAL FIELD

The present invention relates to a slide rail unit which is provided between a pair of members making relative reciprocation along a predetermined direction, as in the case of a drawer of a piece of furniture or a paper tray of a copying machine, for supporting a relative advancing/retreating movement of these members, and in particular, to a slide rail unit which, at a stroke end of such the advancing/retreating movement, can urge a movable member toward the stroke end and retain the movable member at the stroke end position.

BACKGROUND ART

Up to now, as a guide member for supporting an advancing/retreating movement of a movable member, such as a drawer in a piece of furniture or a system kitchen, there is known a slide rail unit equipped with an outer rail and an inner rail (see JP 11-201158 A, etc.). More specifically, the conventional slide rail unit is composed of an outer rail formed into a channel-like shape by bending and raising a pair of ball rolling portions along the longitudinal direction thereof, an inner rail one size smaller than the outer rail and also formed into a channel-like shape by bending and raising a pair of ball rolling portions, a large number of balls rolling on an inner side of the ball rolling portions of the outer rail and on an outer side of the ball rolling portions of the inner rail, and a retainer for aligning the balls at predetermined intervals between the outer rail and the inner rail. When the slide rail unit is used, the outer rail is fixed, for example, to the furniture main body, and the inner rail is fixed to either side surface of the drawer.

The inner rail is fit-engaged with the inner side of the outer rail through the intermediation of the balls, so the inner rail can be freely drawn out of the outer rail. As the inner rail is drawn out, the balls move within the outer rail together with the retainer, whereby it is possible for the drawer to be freely drawn into and out of the furniture main body.

As an example of the slide rail unit, there has also been proposed a type of slide rail unit in which, in order to avoid a half-open state of the drawer once closed and to eliminate inconvenience of the drawer opening of its own accord due to an earthquake, etc., when the inner rail has been accommodated in the outer rail to a certain degree, there is exerted on the inner rail an urging force drawing it into the outer rail, and by this urging force, the inner rail is drawn into the outer rail, and is retained as it is (JP 6-245830 A, JP 11-206489 A, JP 2004-344188 A).

In the slide rail unit disclosed in JP 6-245830 A, a roller provided on the inner rail side rolls on the outer rail, whereby the inner rail can freely advance and retreat along the outer rail; when drawing the inner rail into the outer rail, the roller climbs over a plate spring provided on the outer rail side, with the roller being urged by the plate spring in the direction in which the inner rail is drawn in. Further, unless the roller climbs over the plate spring in the opposite direction, the inner rail cannot be drawn out of the outer rail; thus, a slight locking force is exerted in the direction in which the inner rail is drawn out of the outer rail.

In the slide rail unit disclosed in JP 11-206489 A, a regulating member constructed of a plate spring is arranged in the outer rail so as to be free to rotate and in a state of being urged into a predetermined posture, and an engagement shaft to be engaged with the regulating member is provided fixedly and upright on the inner rail. When the inner rail is forced into the outer rail, the engagement shaft pressurizes the regulating member, which at first exerts an urging force in a direction of pushing back the inner rail; when, however, the inner rail is forced in against this urging force, the regulating member rotates to get over the dead center, and exerts this time an urging force to draw the inner rail into the outer rail. Further, when drawing the inner rail out of the outer rail, the regulating member is required to rotate to get over the dead center again. As a result, a slight locking force is exerted in a direction in which the inner rail is drawn out of the outer rail.

In the slide rail unit disclosed in JP 2004-344188 A, a guide case for a piece component urged by a spring is mounted to the outer rail; a pin provided upright on the inner rail side is engaged with or detached from the piece component sliding within this case, whereby the inner rail is drawn into the outer rail, and the inner rail drawn in is retained in the outer rail. The piece component, which is engaged with or detached from a pin on the inner rail side, is formed of synthetic resin in a predetermined shape, and is endowed with elasticity; thus, it undergoes elastic deformation within the case, thereby allowing engagement and detachment of the pin.

Patent Document 1: JP 11-201158 A
Patent Document 2: JP 6-245830 A
Patent Document 3: JP 11-206489 A
Patent Document 4: JP 2004-344188 A

DISCLOSURE OF THE INVENTION

Problems to be Solved by the Invention

However, in the slide rail units disclosed in JP 6-245830 A and JP 11-206489 A, when accommodating the inner rail in the outer rail, it is necessary to force the inner rail into the outer rail right against the urging force of the plate spring; for example, when forcing a drawer into the furniture main body, a large pressing force is required. Further, in the case where the inner rail is urged by using a plate spring, it is impossible to set a long distance through which the urging force is exerted, and the urging force is exerted abruptly through a short distance, resulting in discomfort in opening and closing the drawer.

In the slide unit disclosed in JP 2004-344188 A, it is necessary to provide a piece component made of a synthetic resin, a case for guiding the same, etc., so its assembly takes time and effort, further involving a high production cost. Further, the piece component allows the engagement or detachment of the inner rail side pin through its elastic deformation, so there are limitations regarding the materials that can be selected, which also leads to a high production cost.

Means for Solving the Problems

The present invention has been made in view of the above-mentioned problems. It is an object of the present invention to provide a slide rail unit with a retaining function, which, when accommodating the inner rail in the outer rail, makes it possible to automatically draw the inner rail into the outer rail without imparting a large pressing force thereto and to maintain the drawn-in state and which can be produced easily with a small number of parts and at low cost.

That is, the slide rail unit of the present invention is composed of a first rail, a second rail capable of stroke movement along the longitudinal direction of the first rail, and an end urging means for urging the second rail toward the stroke end of the second rail in the vicinity of the stroke end. When, for example, the second rail is drawn into the first rail, the end urging means urges the second rail toward the stroke end in the vicinity of the movement stroke thereof, assisting the drawing-in of the second rail and exerting a retaining force for maintaining the state in which the second rail has been drawn in to the stroke end. With this construction, in the drawer of a piece of furniture, etc. supported by using the slide rail unit, it is possible to prevent the drawer from being placed in a half-open state by the reaction at the time of closing or being inadvertently opened by an earthquake.

The end urging means is composed of a retaining pin provided upright so as to be movable with respect to the first rail in the longitudinal direction and the width direction thereof, an elastic member for constantly urging the retaining pin toward the stroke end of the second rail, a pin guide member provided on the first rail and adapted to lock the retaining pin to a standby position spaced apart from the stroke end against an urging force of the elastic member and to guide the retaining pin detached from the standby position with the urging force toward the stroke end, and a cam member provided on the second rail and adapted to detach the retaining pin from the standby position of the pin guide member as it overlaps the pin guide member and to lock the retaining pin after the detachment.

The retaining pin is provided on the first rail and is locked to the standby position of the pin guide member with the elastic member expanded, and is constantly under the urging force of the elastic member. Thus, when the retaining pin is detached from the standby position, it is moved toward the stroke end of the second rail by the urging force of the elastic member. On the other hand, as it overlaps the pin guide member on the first rail side, the cam member provided on the second rail acts so as to cause the retaining pin to be detached from the standby position, and locks the retaining pin after the detachment.

Thus, when the second rails makes a stroke movement with respect to the first rail, and the cam member gradually overlaps the pin guide member, the retaining pin is detached from the standby position of the pin guide member, and is caught by the cam member, with the second rail being pulled toward the stroke end by the urging force of the elastic member. As a result, it is possible to automatically draw in the second rail with respect to the first rail and to maintain the drawn-in state.

At this time, the retaining pin, which has been set at the standby position, solely undergoes a change in the set position thereof by the cam member, so when detaching the retaining pin from the standby position, there is no need to impart to the second rail a pressing force against the urging force of the elastic member, and it is possible to automatically draw in the second rail with respect to the first rail solely by slightly moving the second rail. Further, it is only necessary for the cam member to consist of a cam groove acting on the retaining pin and formed in the second rail, thus allowing the production to be conducted easily with a small number of parts and at low cost.

DESCRIPTION OF REFERENCE NUMERALS

1 . . . OUTER RAIL, 2 . . . INNER RAIL, 3 . . . BALLS, 30 . . . RETAINING PIN, 31 . . . ELASTIC MEMBER, 32 . . . PIN GUIDE MEMBER, 33 . . . CAM MEMBER, 60 . . . GUIDE GROOVE, 64 . . . GUIDE GROOVE

BEST MODE FOR CARRYING OUT THE INVENTION

In the following, a slide rail unit of the present invention will be described in detail with reference to the accompanying drawings.

Figure 1:
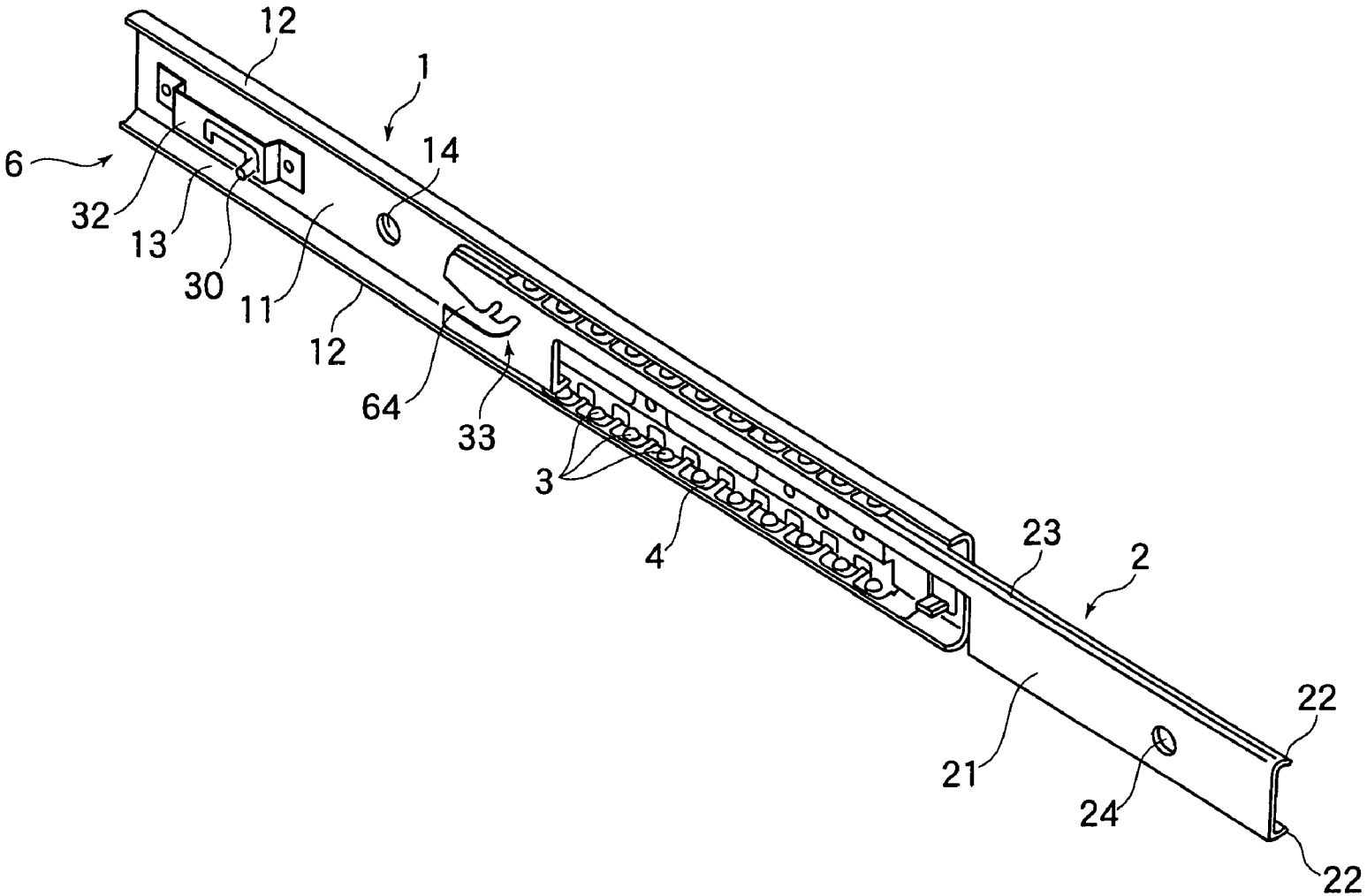
FIG. 1 A perspective view of a slide rail unit according to a first embodiment of the present invention.

FIG. 1 shows a slide rail unit according to an embodiment of the present invention. The slide rail unit is composed of an outer rail 1, an inner rail 2 accommodated in the outer rail 1, balls 3 serving as rolling members rolling between the outer rail 1 and the inner rail 2, and a retainer 4 for aligning a large number of balls 3 at predetermined intervals between the outer rail 1 and the inner rail 2.

Figure 2:
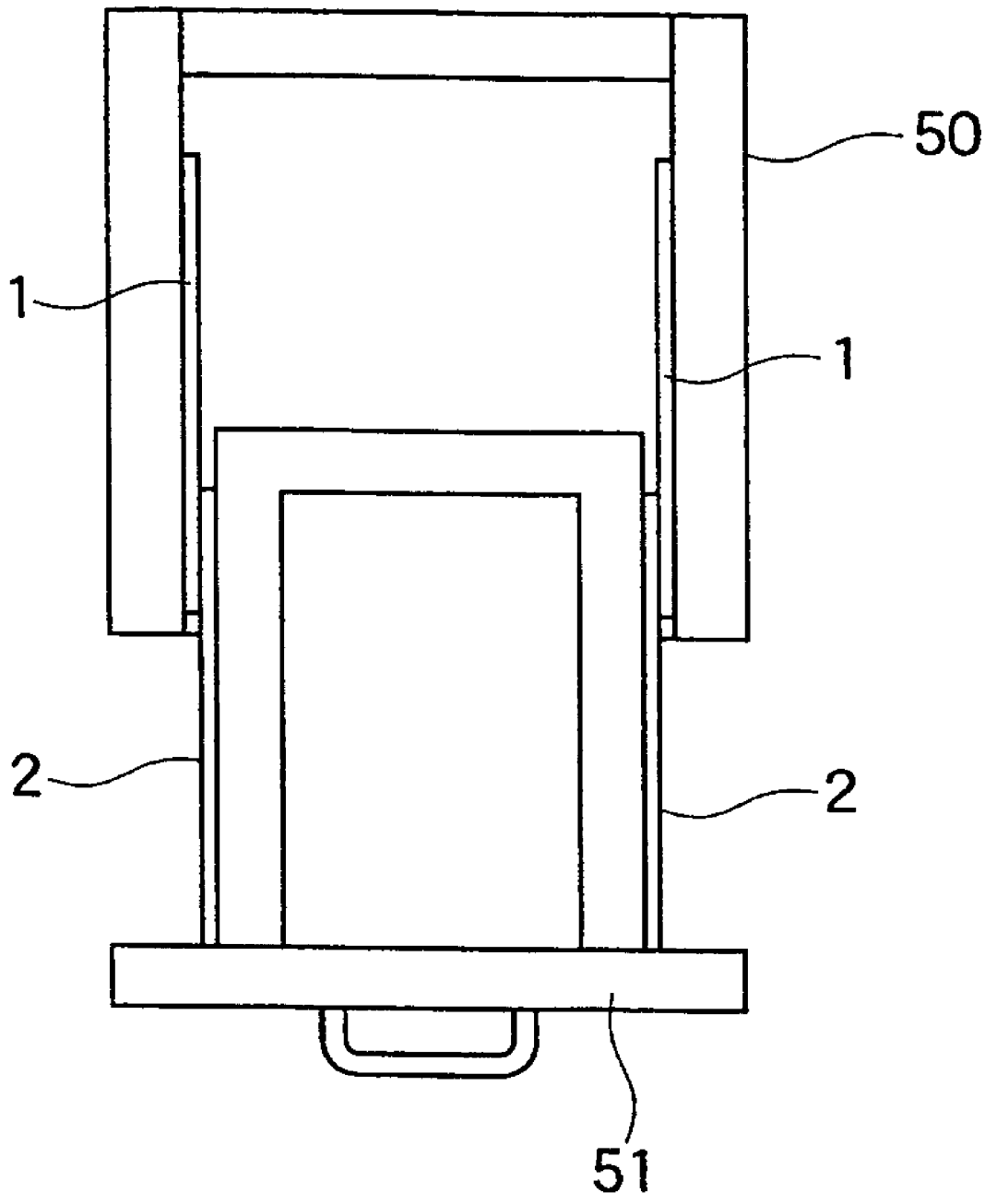
FIG. 2 A plan view showing the slide rail unit of FIG. 1 as applied to a drawer slide mechanism.

As shown, for example, in FIG. 2, the slide rail unit is used as a slide mechanism of a drawer 51 associated with a furniture main body 50. The outer rail 1 is fixed to the furniture main body 50, and the inner rail 2 is fixed to the drawer 51, making it possible for the drawer 51 to be smoothly drawn into and out of the furniture main body 50.

The outer rail 1 is precision-shaped by roll forming of a steel plate, and it is formed into a channel-like shape by bending and raising a pair of ball rolling portions 12, 12 along the longitudinal direction of a mounting portion 11. Further, on inner side surfaces of the ball rolling portions 12, there are formed ball rolling surfaces 13 whose curvature is close to that of the spherical surfaces of the balls 3.

Similarly, the inner rail 2 is also formed of a steel plate in a channel-like shape by bending and raising a pair of ball rolling portions 22, 22 along the longitudinal direction of amounting portion 21. The inner rail 2 is accommodated between the ball rolling portions 12, 12 of the outer rail 1, and the balls 3 are arranged between the inner rail 2 and the outer rail 1, so the inner rail 2 is formed one size smaller than the outer rail 1, and ball rolling surfaces 23 are formed on the outer side surfaces of the ball rolling portions 22.

Figure 3:
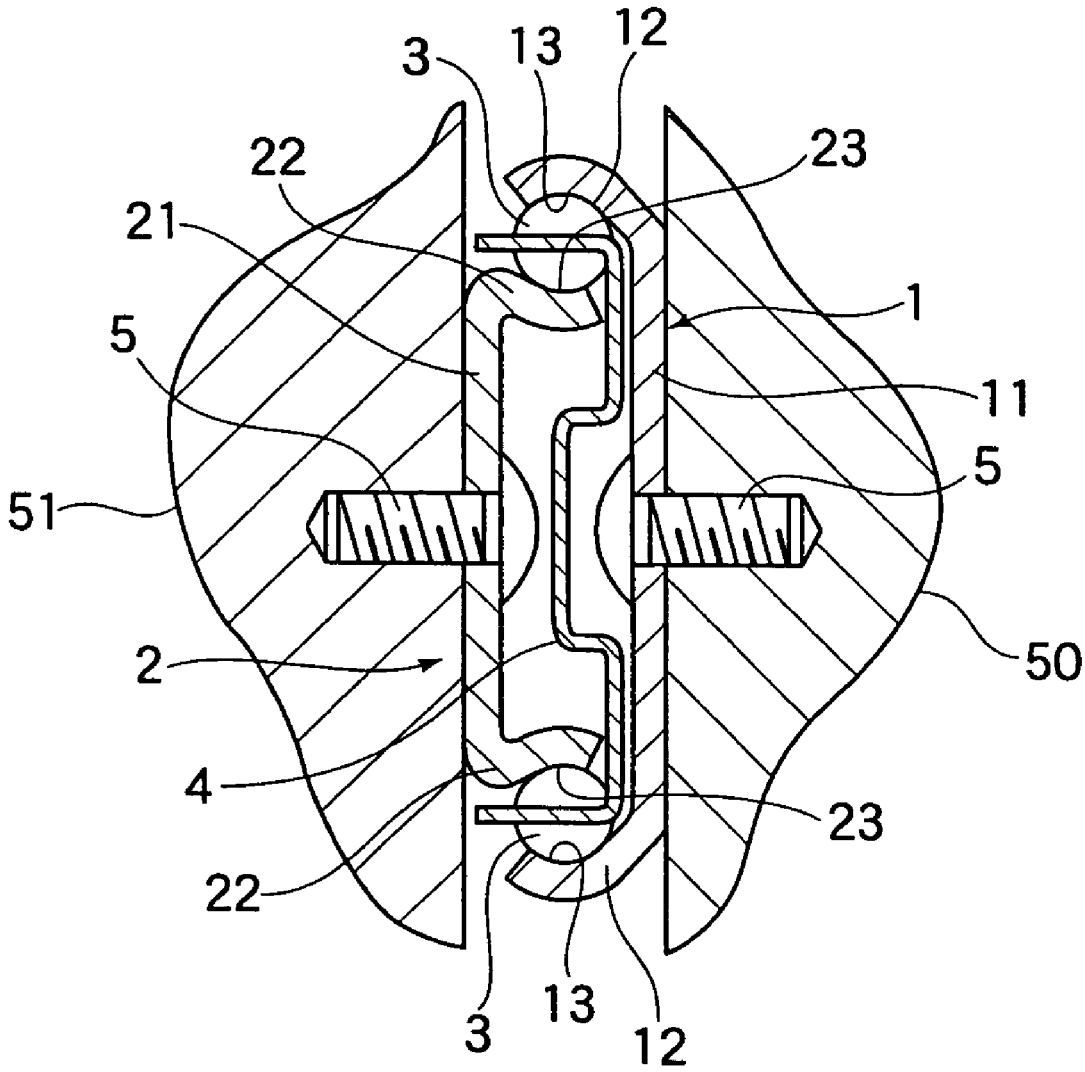
FIG. 3 A front sectional view of the slide rail unit shown in FIG. 1.

The respective mounting portions 11, 21 of the rails 1, 2 have screw holes 14, 24 through which mounting screws 5 are passed; as shown in FIG. 3, the outer rail 1 is fixed, for example, to the furniture main body 50 by using the mounting screw 5, and the inner rail 2 is fixed to the drawer 51 by using the mounting screw 5.

The retainer 4 is formed by stamping of a steel plate or injection molding of synthetic resin. As shown in FIG. 1, the retainer 4 is inserted between the outer rail 1 and the inner rail 2, and aligns the large number of balls 3 rolling between the rails 1, 2 at equal intervals, preventing the adjacent balls from coming into contact with each other.

In this slide rail unit, constructed as described above, the outer rail 1 and the inner rail 2 are fit-engaged with each other through the intermediation of the balls 3 as stated above, so, due to the rolling of the balls 3, the inner rail 2 accommodated in the outer rail 1 can be smoothly pulled out.

In this slide rail unit, its total length is minimum in the state in which the inner rail 2 and the outer rail 1 are completely superimposed one upon the other, that is, in the state in which the inner rail 2 has been completely drawn into the outer rail 1. For example, the state in which the above-mentioned drawer 51 has been completely accommodated in the furniture main body 50 corresponds to this state. To reliably accommodate the drawer 51 in the furniture main body 50 in such the use, and to maintain the above-mentioned state, this slide rail unit is provided with a mechanism 6 for assisting the drawing of the inner rail 2 into the outer rail 1. When drawing the inner rail 2 into the outer rail 1, the mechanism 6 functions slightly in front of the stroke end position of the inner rail 2, drawing the inner rail 2 into the outer rail 1 by using the urging force of a tensile spring serving as an elastic member.

This assisting mechanism, that is, the end urging means 6 of the present invention, is composed of a retaining pin 30 provided so as to be movable with respect to the outer rail 1, an elastic member 31 constantly urging the retaining pin 30 in the drawing-in direction for the inner rail 2, a pin guide member 32 fixed to the outer rail 1 and adapted to move the retaining pin 30 along a predetermined path, and a cam member 33 provided on the inner rail 2 and adapted to move the retaining pin 30 in accordance with the movement of the inner rail 2. As shown in FIG. 1, it is attached to an end portion of the outer rail and the inner rail. When the inner rail 2 is drawn into the outer rail 1, the cam member 33 provided on the inner rail 2 side is engaged with the retaining pin 30 on the outer rail 1 side, and the tensile force (i.e., urging force) of the elastic member 31 acts on the inner rail 2 through the retaining pin 30, so, due to this urging force, the inner rail 2 can be completely drawn into the outer rail 1.

Figure 4A:
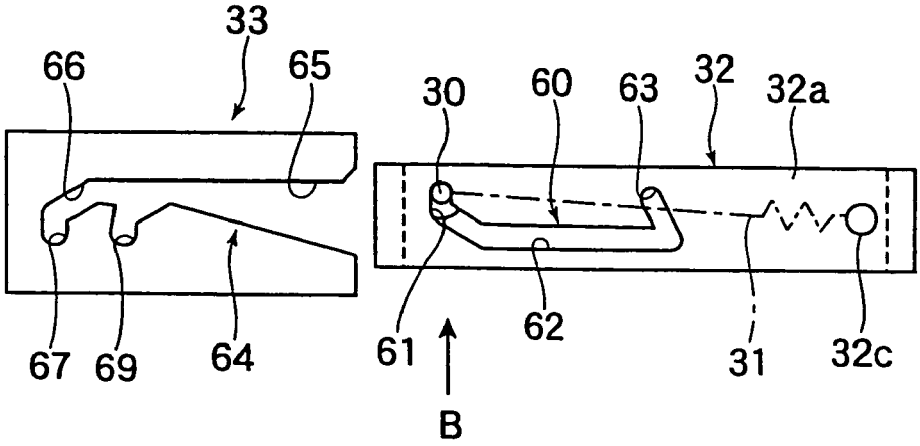
FIG. 4*a* A plan view showing the relationship between a retaining pin, a pin guide member, and a cam member.
Figure 4B:
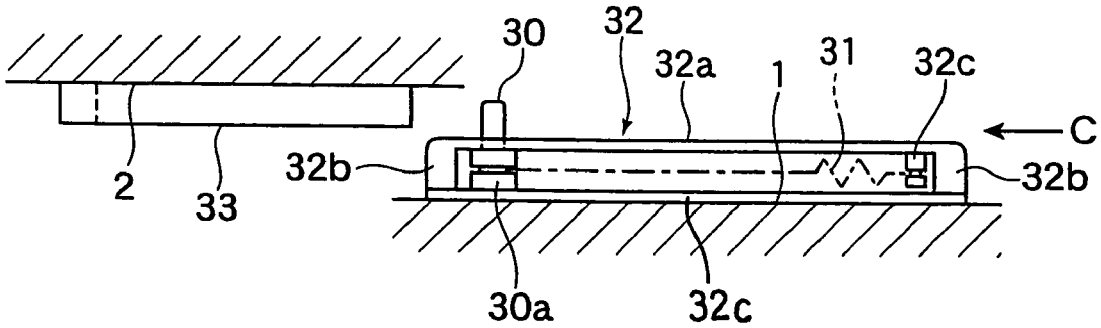
FIG. 4*b* A view taken in the direction of the arrow B of FIG. 4*a*.
Figure 4C:
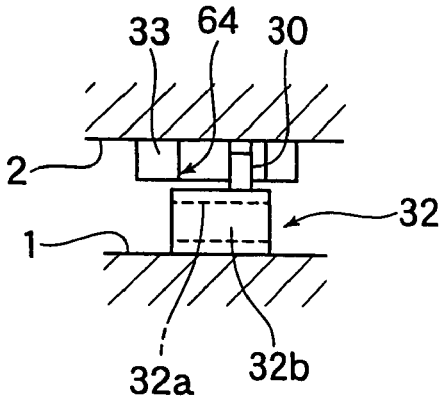
FIG. 4*c* A view taken in the direction of the arrow C of FIG. 4*b*.
Figure 5:
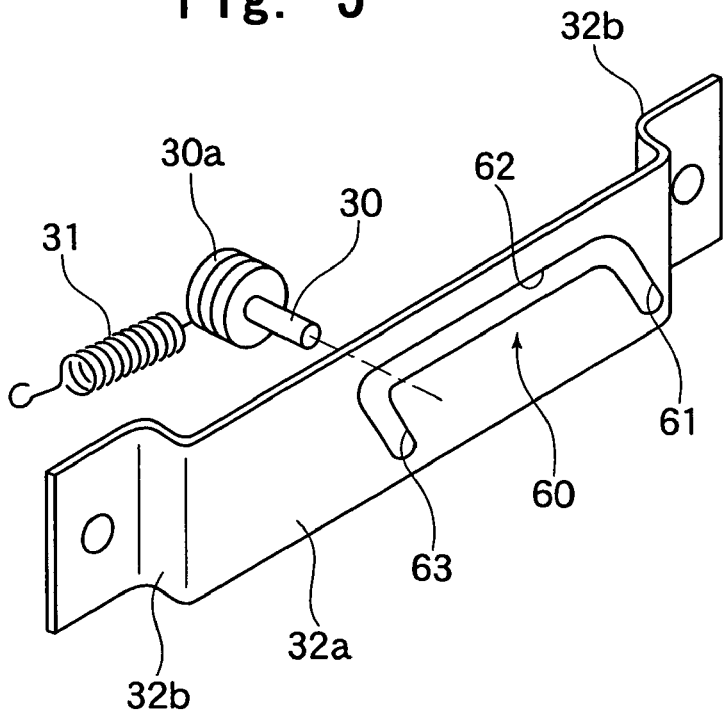
FIG. 5 An exploded perspective view showing the relationship between the retaining pin, the pin guide member, and an elastic member.

FIGS. 4*a*, 4*b*, and 4*c* are diagrams showing the relationship among the retaining pin 30, the pin guide member 32, and the cam member 33. FIG. 4*b* is a view taken in the direction of the arrow B of FIG. 4*a*, and FIG. 4*c* is a view taken in the direction of the arrow C of FIG. 4*b*. In the drawings, the pin guide member 32 is formed of synthetic resin, and has a front plate portion 32*a*, a pair of leg portions 32*b*, 32*b* protruding from both sides of the front plate portion 32*a*, and a back plate portion 32*c* opposed to the front plate portion 32*a* through the intermediation of the leg portions 32*b*, with the back plate portion being fixed to the outer rail 1. A space is defined between the front plate portion 32*a* and the back plate portion 32*c*, and this space constitutes a movement space for the retaining pin 30. The front plate portion 32*a* has a guide groove 60 for regulating the movement of the retaining pin 30, and the distal end of the retaining pin 30 is inserted into the guide groove 60, and protrudes toward the cam member 33. On the other hand, the retaining pin 30 has a disc-like base portion 30*a*, and the base portion 30*a* is held between the back plate portion 32*c* and the front plate portion 32*a* of the pin guide member 32. Thus, the retaining pin 30 is freely movable with respect to the outer rail 1, with its distal end protruding from the guide groove 60. When an external force is applied thereto, the distal end moves within the guide groove 60 according to the direction of the force. As shown in FIG. 5, it is also possible for the pin guide member 32 to be formed by bending a metal plate. In this case, the back plate 32*c* is omitted, and it is possible to fix the leg portions 32*b* directly to the outer rail 1.

One end of the tensile spring 31 serving as the elastic member is fixed to the base portion 30*a* of the retaining pin 30, and the other end of the tensile spring 31 is fixed to a stud 32*c* provided on the pin guide member 32. The stud 32*c* is situated at an end side of the outer rail 1 with respect to the guide groove 60. At no matter which position in the guide groove 60 the retaining pin 30 may be set, the tensile spring 31 is in the expanded state, and the urging force of the tensile spring 31 is constantly acting on the retaining pin 30 in the direction of the end of the outer rail 1, that is, in the direction in which the inner rail 2 is drawn in.

The guide groove 60 has a lock recess 61 for locking the retaining pin 30 against the urging force of the tensile strength 31, and a pulling guide portion 62 continuous with the lock recess 61 and formed to extend in the longitudinal direction of the outer rail 1. The lock recess 61 corresponds to a standby position at which the retaining pin 30 is set when the inner rail 2 is drawn out of the outer rail 1. When the retaining pin 30 is set at the lock recess 61, the tensile spring 31 is in the most expanded state. Thus, when the retaining pin 30 is caused to get out of the lock recess 61, which is the standby position, by the action of the cam member 33 described below, the retaining pin 30 moves at a stroke through the pulling guide portion 62 due to the urging force of the tensile spring 31, and reaches the end of the pulling guide portion 62.

At the end of the pulling guide portion 62, which is in close proximity to the stud 32*c*, there is formed a retraction recess 63 to be utilized when re-setting the retaining pin 30 at the standby position when it has been detached from the standby position (i.e., lock recess 61) independently of the movement of the cam member 33 on the inner rail 2 side. The retraction recess 63 is formed so as to obliquely cross the pulling guide portion 62. As to the way the retraction recess 63 is utilized, it will be described in detail below.

Next, the cam member 33 provided on the inner rail 2 side will be described. The cam member 33 is formed by cutting out a guide groove 64 in a metal plate, and is fixed to the inner side surface of the inner rail 2 so as to be opposed to the pin guide member 32 on the outer rail 1 side. The guide groove 64 is formed as a so-called cam groove which changes the set position of the retaining pin 30 according to the movement of the inner rail 2 with respect to the outer rail 1, and is equipped with an introducing portion 65 for receiving the distal end of the retaining pin 30 set at the standby position, an acting portion 66 for moving the received retaining pin 30 in the width direction of the outer rail 1 to detach the pin 30 from the standby position, and a pin detaining portion 67 for locking the retaining pin 30 having passed the acting portion 66. The pin detaining portion 67 is opposed to the pulling guide portion 62 of the pin guide member 32. The retaining pin 30 can move through the pulling guide portion 62 while being locked to the pin detaining portion 67.

Figure 6:
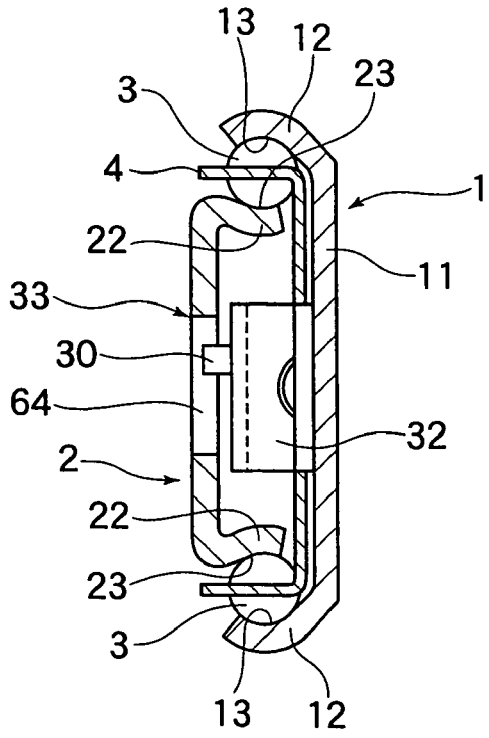
FIG. 6 A front sectional view showing a state in which the retaining pin has been inserted into a guide groove formed in an inner rail.

As shown in FIG. 4*c*, the pin guide member 32 and the cam member 33 are opposed to each other between the outer rail 1 and the inner rail 2, and the distal end of the retaining pin 30 protruding from the pin guide member 32 is inserted into the guide groove 64 of the cam member 33. It should be noted, however, that it is only necessary for the cam member 33 to be one equipped with the guide groove 64 into which the distal end of the retaining pin 30 is to be inserted, so, instead of fixing the cam member 33 with the guide groove 64 to the inner rail 2, it is also sufficiently possible, as shown in FIGS. 1 and 6, to form the guide groove 64 directly in the mounting portion 21 of the inner rail 2, using the portion where the guide groove is formed as the cam member 33.

Figure 7A:
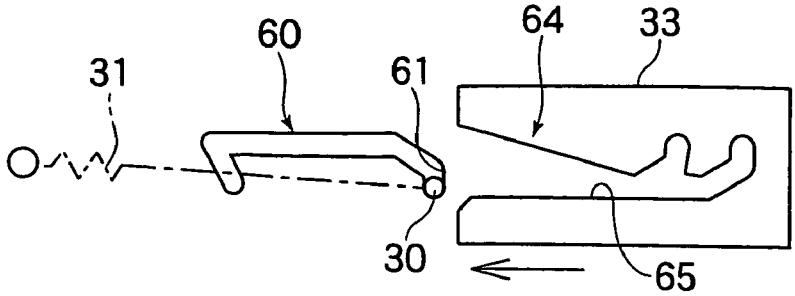
FIG. 7 Sequential explanatory views illustrating the movement of the retaining pin when the inner rail is drawn into an outer rail.
Figure 7B:
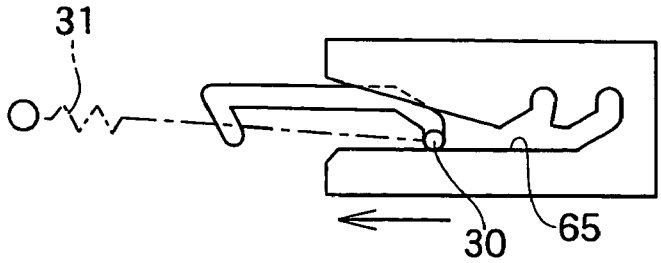
Figure 7C:
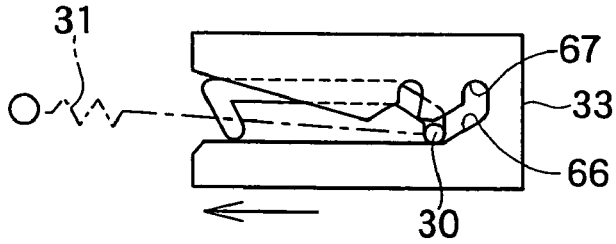
Figure 7D:
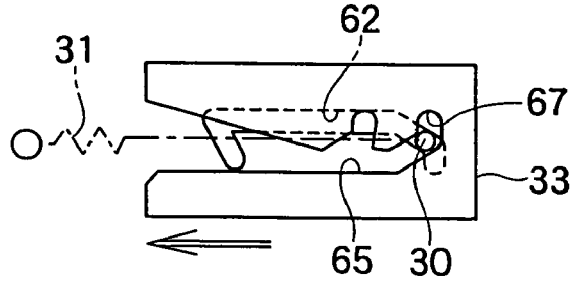

FIGS. 7*a* through 7*f* sequentially show the operation of the retaining pin 30 when drawing the inner rail 2 into the outer rail 1. As shown in FIG. 7*a*, in the state in which the inner rail 2 has been drawn out of the outer rail 1, with the cam member 33 being completely separated from the guide groove 60 of the pin guide member 32, the retaining pin 30 is set at the standby position, that is, the lock recess 61 of the guide groove 60. In this state, the tensile force of the elastic member 31 is being applied to the retaining pin 30. The retaining pin 30, however, is locked to the lock recess 61, maintaining the state of being set at the standby position. Here, when the inner rail 2 is drawn into the outer rail 1, and the cam member 33 overlaps the guide groove 60 as shown in FIG. 7*b*, the retaining pin 30 enters the guide groove 64 from the introducing portion 65, and when the drawing-in of the inner rail 2 is allowed to progress, the pin abuts the acting portion 66 as shown in FIG. 7*c*. The acting portion 66 is provided obliquely with respect to the moving direction of the inner rail, so when the drawing-in of the inner rail progresses, the retaining pin 30 is biased in a direction perpendicular to the moving direction of the inner rail (i.e., the direction indicated by the arrow in the drawing) as shown in FIG. 7*d*, and is detached from the lock recess (i.e., standby position) 61 of the guide groove 60. In the guide groove 64 of the cam member 33, the retaining pin 30 passes the acting portion 66 to enter the pin detaining portion 67, and the retaining pin 30 is locked to the pin detaining portion 67.

Figure 7E:
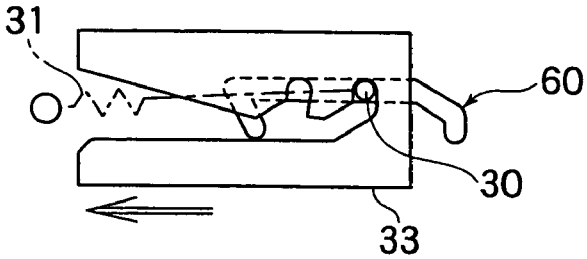
Figure 7F:
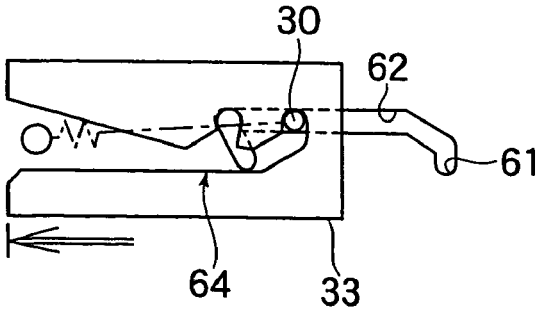

As described above, the pin detaining portion 67 of the cam member 33 is opposed to the pulling guide portion 62 of the guide groove 60, so when the retaining pin 30 is set at the pin detaining portion 67 of the cam member 33 as shown in FIG. 7*e*, the retaining pin 30 is caused to move, by the urging force of the elastic member 31, at a stroke through the pulling guide portion 62 in the direction in which the inner rail 2 is drawn in. At this time, the retaining pin 30 is locked to the pin detaining portion 67 of the cam member 33, so the tensile urging force of the elastic member 31 is applied to the cam member 33 and, by extension, to the inner rail 2 through the retaining pin 30, thereby the inner rail 2 is automatically drawn into the outer rail 1. As a result, as shown in FIG. 7*f*, the inner rail 2 is drawn in to the end position of the stroke range, and retained at that position by the urging force of the elastic member 31.

In this way, in the slide rail unit of the present invention, when, in drawing the inner rail 2 into the outer rail 1, the inner rail 2 reaches the vicinity of the end of the stroke range thereof, the retaining pin 30 is detached from the standby position by the action of the cam member 33 on the inner rail 2 side, and the urging force of the elastic member 31 being applied to the retaining pin 30 is applied at a stroke, making it possible to automatically draw the inner rail 2 into the outer rail 1. Further, in the drawn-in state, the urging force of the elastic member 31 acts as a retaining force, so it is possible to prevent the inner rail 2 from inadvertently projecting from the outer rail. For example, when this slide rail unit is used in a drawer guide mechanism, it is possible to prevent a half-open state of the drawer.

When drawing the inner rail 2 out of the outer rail 1, the retaining pin 30 is set at the standby position in an order completely reverse to that shown in FIGS. 7*a* through 7*f*. That is, the inner rail 2 is drawn out of the outer rail 1, with the retaining pin 30 being locked to the pin detaining portion 67 of the cam member 33, so the retaining pin 30 moves through the pulling guide portion 62 toward the lock recess 61 against the urging force of the elastic member 31. The portion of the guide groove 60 from the pulling guide portion 62 to the lock recess 61 is formed obliquely with respect to the direction in which the inner rail 2 is drawn out, so when the inner rail 2 is further drawn out of the outer rail 1, the guide groove 60 acts on the retaining pin 30 as a cam groove, and the retaining pin 30 is set at the lock recess 61 while biased in a direction perpendicular to the moving direction of the inner rail 2. Further, at this time, the retaining pin 30 is detached from the pin detaining portion 67 of the cam member 33, and reaches the introducing portion 65 by way of the acting portion 66 (the state as shown in FIG. 7*c*). As a result, it is possible to detach the retaining pin 30 from the cam member 33, and to draw the inner rail 2 out of the outer rail 1 by separating the cam member 33 on the inner rail 2 side from the pin guide member 32 on the outer rail 1 side. Further, the retaining pin 30 is set at the lock recess (i.e., standby position) 61 of the guide groove 60, with the elastic member 31 being expanded; when the inner rail 2 is next drawn into the outer rail 1, it is possible to again assist the drawing-in of the inner rail 2 by the procedures shown in FIGS. 7*a* through 7*f*.

In this way, normally, in the state in which the inner rail 2 has been drawn out of the outer rail 1, the retaining pin 30 is set at the lock recess 61 of the guide groove 60. However, when an impact or the like is applied to the outer rail 1, the retaining pin 30 may be inadvertently detached from the lock recess 61. In this case, the retaining pin drops to the end position of the pulling guide portion 62 as shown in FIG. 7*a*. When the retaining pin 30 is unintentionally set at such a position, unless the retaining pin 30 is restored to the lock recess 61, the retaining pin 30 constitutes an obstacle, making it impossible to draw the inner rail 2 completely into the outer rail 1. In view of this, in this slide rail unit, there is provided a mechanism for restoring the retaining pin 30 to the lock recess (i.e., standby position) 61.

More specifically, there is formed a tapered scooping portion 68 so as to be opposed to the introducing portion 65 of the cam member 33, and, between the scooping portion 68 and the pin detaining portion 67, there is formed a temporary lock recess 69 for temporarily accommodating the retaining pin 30. Like the pin detaining portion 67, the temporary lock portion 69 is opposed to the pulling guide portion 62 of the pin guide member 32. That is, these components constitute a pin restoring portion formed in the cam member 33. As described above, in the guide groove 60 of the pin guide member 32, there is formed the retraction recess 63 which is continuous with the end portion of the pulling guide portion 62. The retraction recess 63 corresponds to the introducing portion 65 of the cam member 33.

Figure 8A:
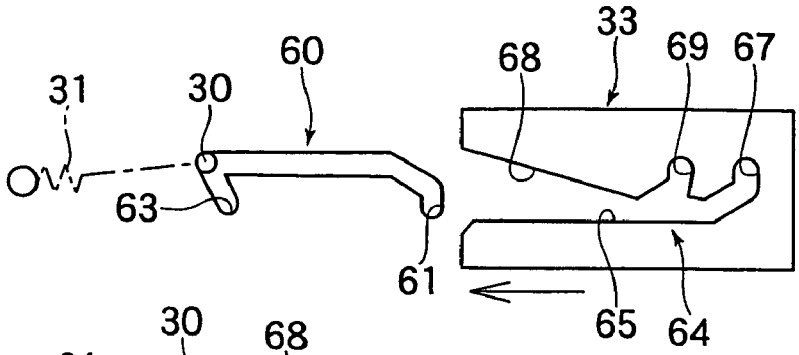
FIG. 8 Sequential explanatory views illustrating the movement of the retaining pin when the retaining pin is restored to a standby position.
Figure 8B:
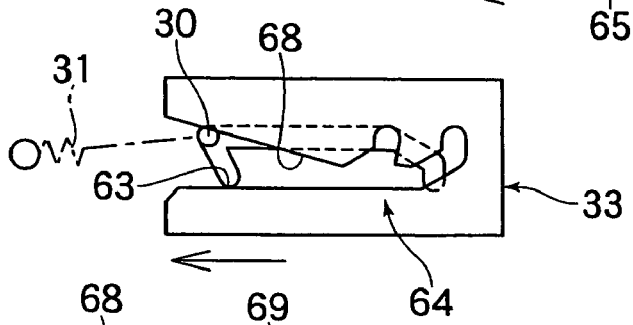
Figure 8C:
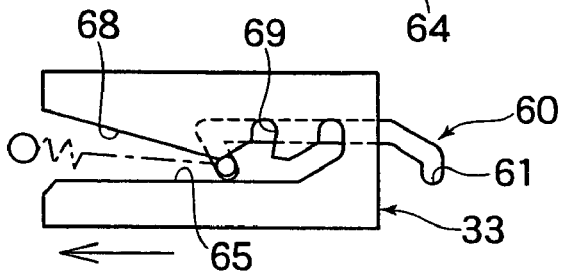
Figure 8D:
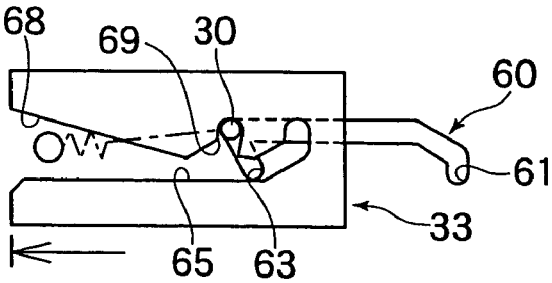

FIGS. 8*a* through 8*f* show a series of movements of the retaining pin 30 when restoring the retaining pin 30, which has been inadvertently detached from the standby position, to the standby position. As shown in FIG. 8*a*, when, in the state in which the inner rail 2 has been drawn out of the outer rail 1, the retaining pin 30 is detached from the standby position and exists in the pulling guide portion 62, it is possible to re-set the retaining pin 30 at the standby position by temporarily drawing the inner rail 2 into the outer rail 1 and by drawing the inner rail 2 out of the outer rail 1 again. As shown in FIGS. 8*a* and 8*b*, when the inner rail 2 is drawn into the outer rail 1, and the cam member 33 begins to overlap the guide groove 60 on the outer rail 1 side, the retaining pin 30 is biased in a direction perpendicular to the drawing-in direction of the inner rail 2 by the scooping portion 68 of the cam member 33, and directly enters the retraction recess 63 of the guide groove 60 (see FIG. 8*c*). The retraction recess 63 is formed obliquely with respect to the drawing-in direction of the inner rail 2, so even when the retaining pin 30 is biased by the scooping portion 68 of the cam member 33, the retaining pin 30 is inclined to return to the pulling guide portion 62 of the guide groove 60 due to the tensile force of the elastic member 31. Thus, when the drawing-in of the inner rail 2 further progresses, and the retaining pin 30 passes the scooping portion 68 as shown in FIG. 8*c*, the retaining pin 30 enters the temporary lock recess 69 provided in the cam member 33, and is locked to the cam member 33 at this position (see FIG. 8*d*).

Figure 8E:
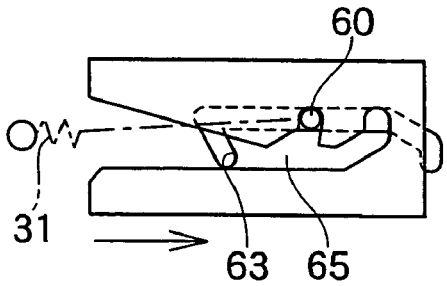
Figure 8F:
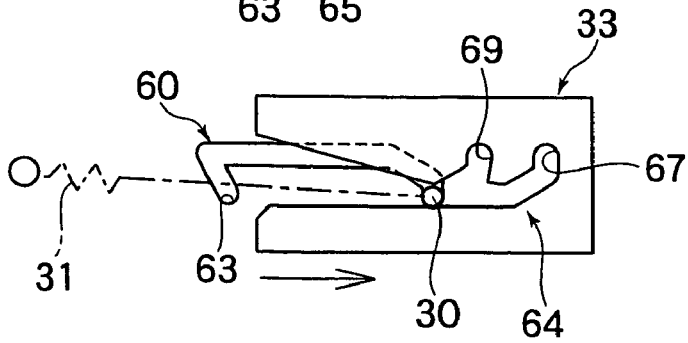

The temporary lock recess 69 is opposed to the pulling guide portion 62 of the guide groove 60, so when the inner rail 2 is further drawn out, with the retaining pin 30 being locked to the temporary lock recess 69 of the cam member 33, the retaining pin 30 moves through the pulling guide portion 62 toward the lock recess 61 against the urging force of the elastic member 31 (see FIG. 8*e*). The portion of the guide groove 60 from the pulling guide portion 62 to the lock recess 61 is formed obliquely with respect to the drawing-out direction of the inner rail 2, so when the inner rail 2 is further drawn out of the outer rail 1, the guide groove 60 acts as a cam groove on the retaining pin 30, and the retaining pin 30 is biased in a direction perpendicular to the moving direction of the inner rail 2 and is set at the lock recess 61. Further, at this time, the retaining pin 30 gets out of the temporary lock recess 69 of the cam member 33, and is set at the introducing portion 65 (the state as shown in FIG. 8*f*). As a result, it is possible to re-set the retaining pin 30 at the lock recess 61 of the pin guide member 32, and to pull the retaining pin 30 out of the cam member 33, making it possible to draw the inner rail out of the outer rail.

Thus, in this slide rail unit, if, with the inner rail 2 drawn out of the outer rail 1, the retaining pin 30 is inadvertently detached from the standby position, and is caused to drop to the end position of the pulling guide groove 62 by the urging force of the elastic member 31, it is possible to restore the retaining pin 30 to the standby position by first drawing the inner rail 2 into the outer rail 1 and then drawing the inner rail 2 out of the outer rail 1 again, thus providing enhanced convenience.

Figure 9:
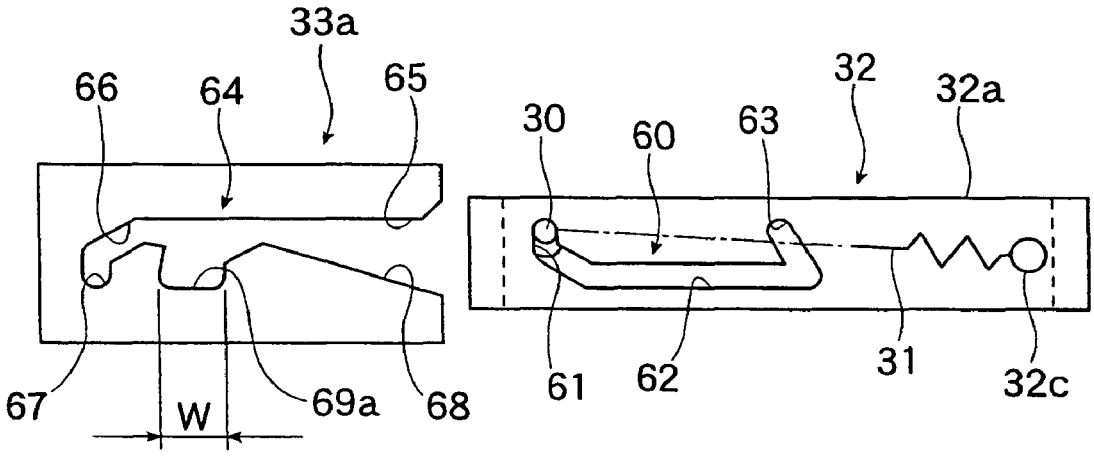
FIG. 9 A plan view of another example of the cam member.

FIG. 9 shows another example of the cam member 33.

As shown in FIG. 2, when using the above-described slide rail unit in the slide mechanism of the drawer 51 associated with the furniture main body 50, if the end of the stroke range when the inner rail 2 is drawn into the outer rail 1 is completely matched with the end when the drawer 51 is drawn into the furniture main body 50, the urging force of the elastic member 31 does not reliably act on the inner rail 2 at this end, and a high level of sealing property may not be maintained between the drawer 51 and the furniture main body 50. That is, to reliably draw the drawer into the furniture main body, it is necessary that, at the end position of the drawer, the inner rail has not reached the end position yet.

However, in the guide groove 64 of the cam member 33 shown in FIG. 4*a*, the temporary lock recess 69 is cut out in correspondence with the end of the stroke range of the inner rail 2, so if the drawing-in of the drawer 51 with respect to the furniture main body 50 is locked before the inner rail 2 reaches the end of the stroke range, it is difficult to move the retaining pin 30 to the temporary lock recess 69 by the procedures as shown in FIG. 8 in the case where the retaining pin 30 inadvertently gets out of the lock recess 61 and drops to the end position of the pulling guide portion 62.

In view of this, in a cam member 33*a* shown in FIG. 9, the width W of a temporary lock recess 69*a* is made larger than that of the temporary lock recess 69 shown in FIG. 4*a*, so the retaining pin 30 can be set at the recess 69 slightly before the inner rail 2 reaches the end of the stroke range.

Figure 10A:
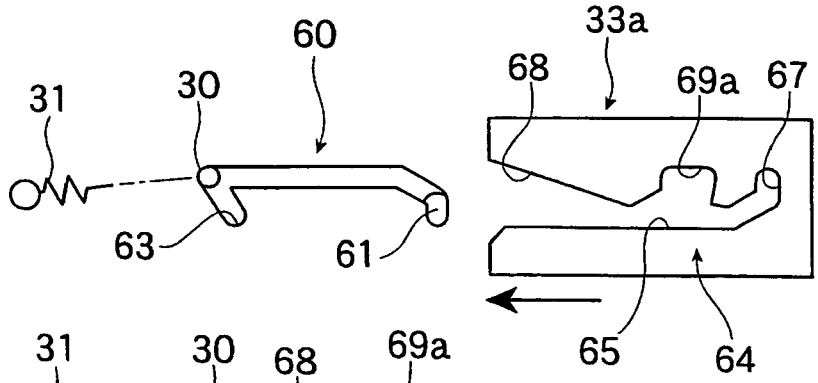
FIG. 10 Sequential explanatory views illustrating the movement of the retaining pin when the retaining pin is restored to the standby position by using the cam member shown in FIG. 9.
Figure 10B:
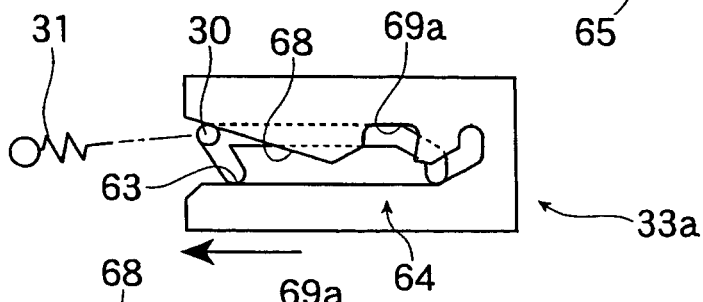
Figure 10C:
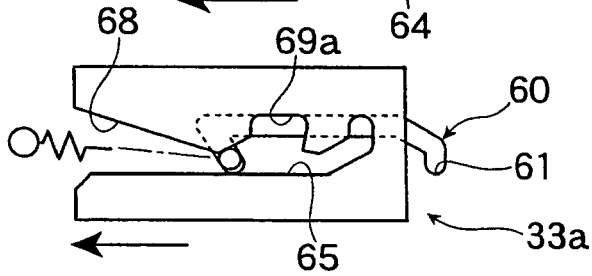

FIGS. 10*a* through 10*f* show a series of movements of the retaining pin 30 when restoring the retaining pin 30 to the standby position by using the cam member 33*a*; the movements are substantially the same as those shown in FIGS. 8*a* through 8*f*. That is, as shown in FIGS. 10*a* through 10*c*, as the inner rail 2 is drawn into the outer rail 1, and the cam member 33*a* overlaps the guide groove 60 on the outer rail 1 side, the retaining pin 30 is biased in a direction perpendicular to the drawing-in direction of the inner rail 2 by the scooping portion 68 of the cam member 33*a*, and directly enters the retraction recess 63 of the guide groove 60. The retraction recess 63 is formed so as to be oblique with respect to the drawn-in direction of the inner rail 2, so also when biased by the scooping portion 68 of the cam member 33*a*, the retaining pin 30 is inclined to be returned to the pulling guide portion 62 of the guide groove 60 by the tensile force of the elastic member 31. Thus, when the drawing-in of the inner rail 2 further progresses, and the retaining pin 30 passes the scooping portion 68 as shown in FIG. 10*c*, the retaining pin 30 enters the temporary lock recess 69*a*, and is locked to the cam member 33 at this position (see FIG. 8*d*).

Figure 10D:
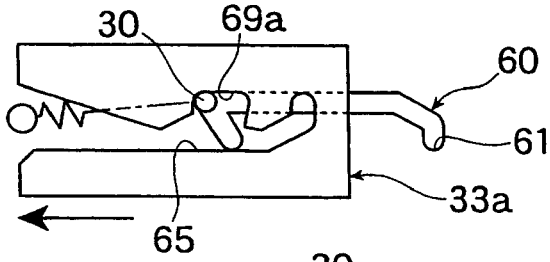
Figure 10E:
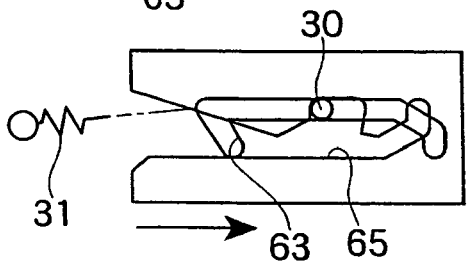
Figure 10F:
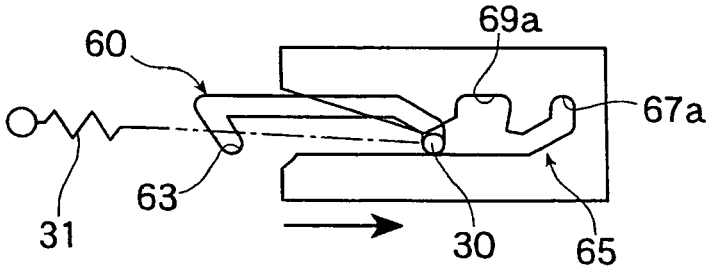

At this time, in FIG. 10*d*, the inner rail 2 has not reached the end of the stroke range thereof. However, due to the enlargement of the formation width W of the temporary lock recess 69*a*, the retaining pin 30 can be set to the temporary lock recess 69*a* at this position. After this, the movements of the retaining pin 30 are completely the same as those shown in FIGS. 8*e* through 8*f*, and a description thereof will be omitted, with the same components being indicated by the same reference numerals in the drawings.

Figure 11:
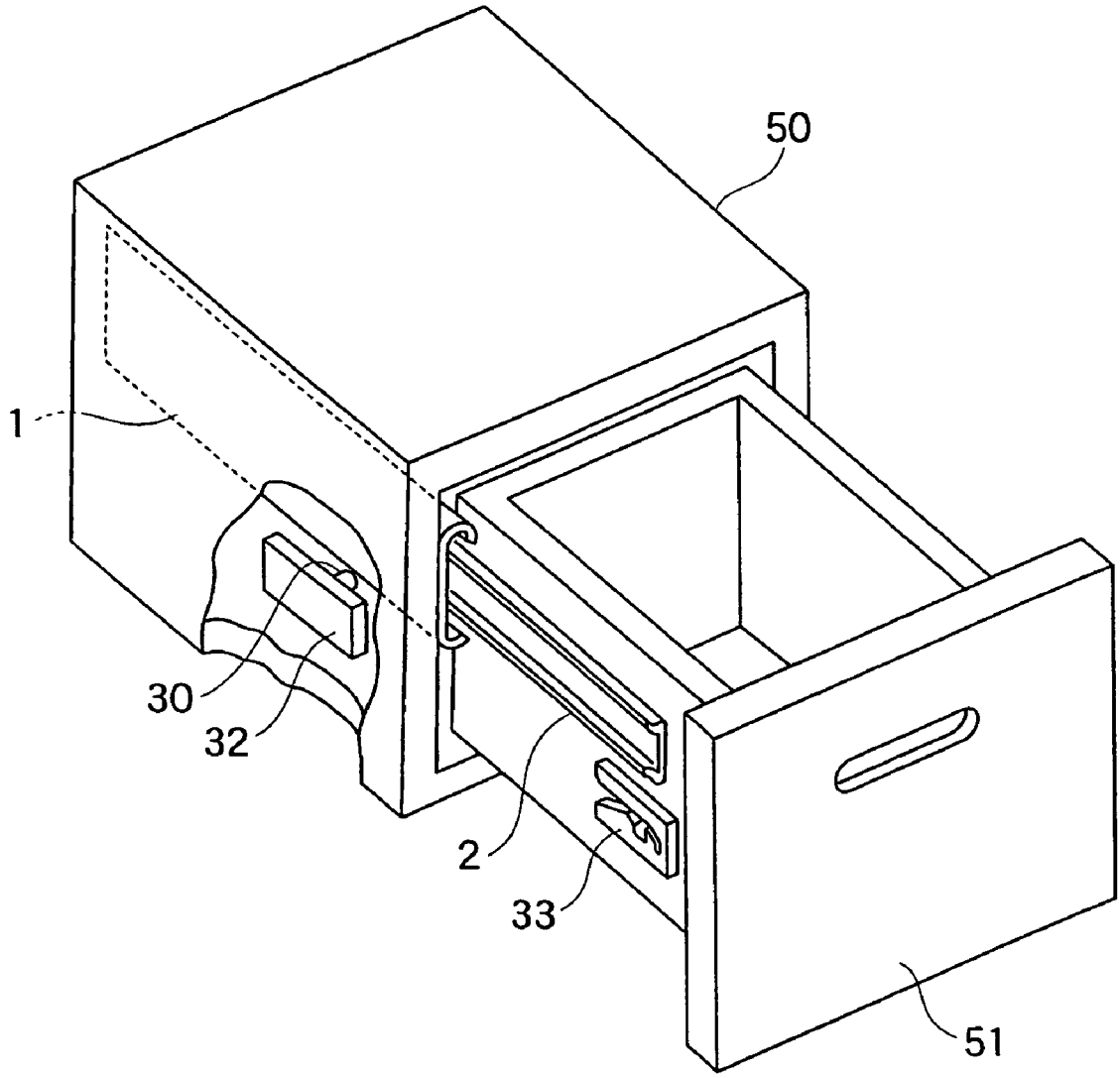
FIG. 11 A perspective view of a slide rail unit according to a second embodiment of the present invention.

FIG. 11 shows a slide rail unit according to another embodiment of the present invention.

In the embodiment shown in FIG. 1, the retaining pin 30, the pin guide member 32, and the cam member 33, which constitute the end urging means 6, are provided directly on the outer rail 1 and the inner rail 2 of the slide rail unit, whereas, in the example shown in FIG. 11, the retaining pin 30 and the pin guide member 32 are provided on the furniture main body 50, and the cam member 33 is provided on the drawer 51, and is separated from the outer rail 1 or the inner rail 2. That is, when the drawer 51 is drawn into the furniture main body 50 by the action of the slide rail unit, the cam member 33 provided on the drawer 51 is engaged with the retaining pin 30 provided on the furniture main body 50, and the tensile force of the elastic member 31 acting on the retaining pin 30 acts on the drawer. In this way, when the retaining pin 30 and the cam member 33 are provided separately from the outer rail 1 and the inner rail 2, it is possible to freely change the timing with which the tensile force of the elastic member 31 acts on the drawer 51 according to, for example, the mounting position of the cam member 33 with respect to the drawer 51; by changing the mounting position of the cam member, the slide rail unit can be flexibly applied to various uses.

Figure 12:
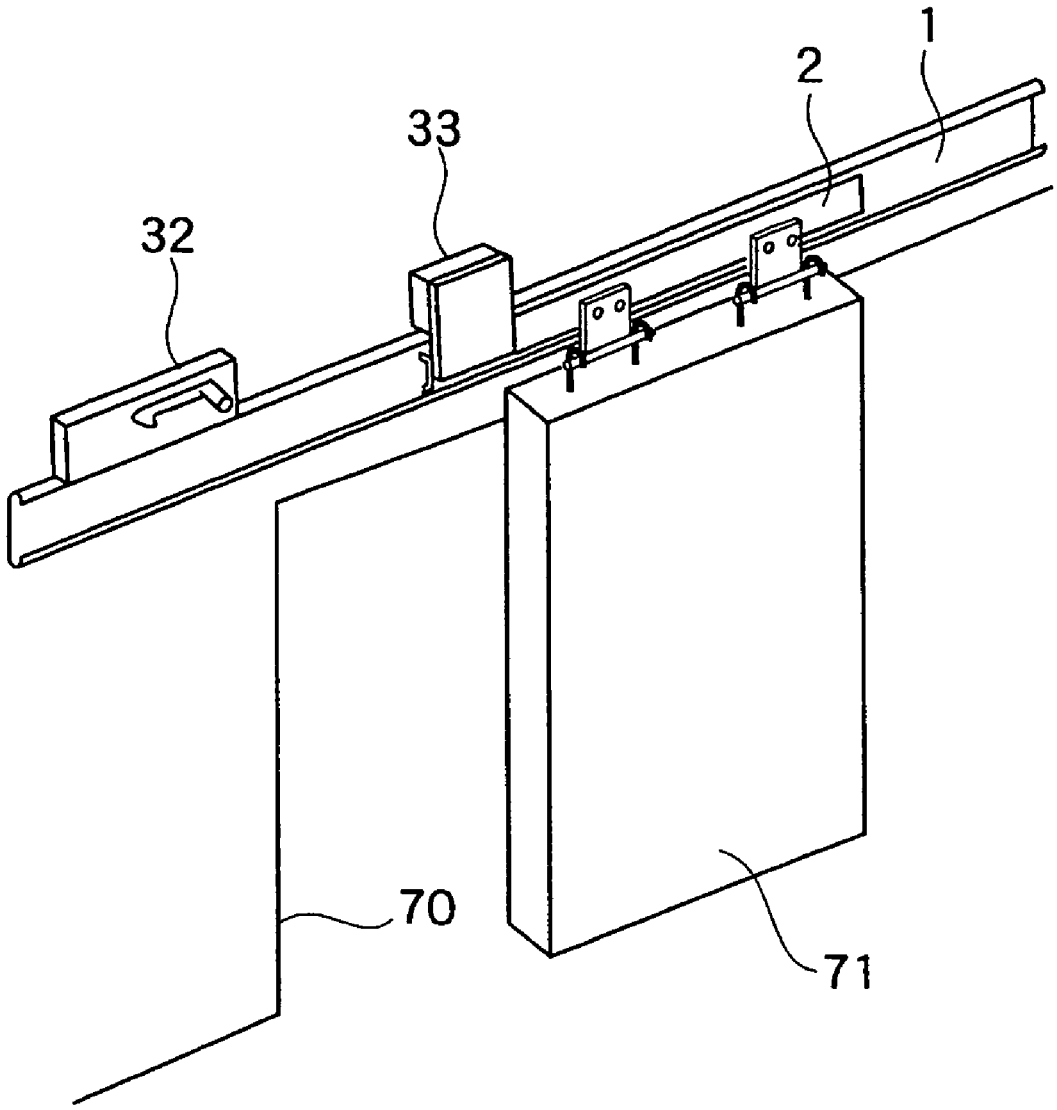
FIG. 12 A perspective view of an example in which a slide rail unit according to the present invention is applied to a sliding door.

FIG. 12 is a diagram showing an example in which a slide rail unit according to the present invention is applied to a sliding door.

In this example, the outer rail 1 of the slide rail unit is fixed in position along the upper end side of an opening 70 of a building, whereas a sliding door 71 for closing the opening 70 is suspended from the inner rail 2. The outer rail 1 is provided with the pin guide member 32 in correspondence with the end of the stroke range of the inner rail 2, and the inner rail 2 is provided with the cam member 33 to be engaged with the retaining pin 30 guided by the pin guide member 32. That is, in the example shown in FIG. 12, when the sliding door 71 is moved to the vicinity of the end of the stroke range of the slide rail unit, the sliding door 71 is automatically urged toward the end position, and is retained at the end position, which is convenient when the sliding door 71 is to be kept locked at the open position or the close position.

While in the slide rail unit shown in FIG. 1 the retaining pin 30 acts when the inner rail 2 is drawn into the outer rail 1, it is also possible to adopt a construction in which the retaining pin 30 acts when the inner rail 2 is drawn out of the outer rail 1 by changing the mounting positions and the mounting orientations of the pin guide member 32 and the cam member 33.

Further, while in an example of this embodiment the pin guide member 32 is fixed to the outer rail 1, and the cam member 33 is fixed to the inner rail 2, it is possible to effect design change such that the cam member 33 is fixed to the outer rail 1 and the pin guide member 32 is fixed to the inner rail 2.

The present invention is applicable between a pair of rails assembled so as to be mutually movable. Thus, for example, in the case where the slide rail unit is composed of three rails, that is, an outer rail, a center rail, and an inner rail, it is possible to apply the present invention between the outer rail and the center rail and between the center rail and the inner rail, which are mutually movable.

Further, while in the above-described embodiments a large number of balls exist between the outer rails and the inner rail, it is possible to adopt any other construction as long as the inner rail is supported so as to be movable with respect to the out rail. For example, a wheel running on the outer rail may be rotatably mounted on the inner rail, or sliding surfaces in sliding contact with each other may be respectively provided on the outer rail and the inner rail.

The invention claimed is:

1. A slide rail unit with a retaining function comprising:

a first rail;

a second rail capable of stroke motion along the longitudinal direction of the first rail; and an end urging means for urging the second rail toward a stroke end in the vicinity of the stroke end of the second rail, the end urging means is composed of a retaining pin provided upright so as to be movable with respect to the first rail (1) in the longitudinal direction and the width direction thereof, an elastic member for constantly urging the retaining pin toward the stroke end of the second rail, a pin guide member provided on the first rail and adapted to lock the retaining pin to a standby position spaced apart from the stroke end against an urging force of the elastic member and to guide the retaining pin detached from the standby position with the urging force toward the stroke end, and a cam member provided on the second rail and adapted to detach the retaining pin from the standby position of the pin guide member as it overlaps the pin guide member and to lock the retaining pin after the detachment, wherein the cam member is equipped with a guide groove for receiving a distal end of the retaining pin and is fixed to the second rail, and that the guide groove is composed of an introducing portion for receiving the retaining pin set to the standby position as the second rail moves, an acting portion for moving the received retaining pin in the width direction of the first rail to detach it from the standby position, and a pin detaining portion for locking the retaining pin having passed the acting portion.

2. A slide rail unit with a retaining function according to claim 1, characterized in that the pin guide member is equipped with a guide groove into which a distal end of the retaining pin is loosely inserted, and is fixed to the first rail, and that the guide groove has a lock recess corresponding to the standby position and has a pulling guide portion for guiding the retaining pin detached from the lock recess in the longitudinal direction of the first rail.

3. A slide rail unit with a retaining function according to claim 2, characterized in that the retaining pin is movably retained between the pin guide member and the first rail.

4. A slide rail unit with a retaining function according to claim 2, characterized in that at one end on the opposite side of the lock recess of the guide groove of the pin guide member, there is formed a retraction recess for allowing advancement of the cam member, with the retaining pin (30) set to that position.

5. A slide rail unit with a retaining function according to claim 1, characterized in that a pin restoring portion for restoring the retaining pin to the standby position is formed between the introducing portion and the acting portion of the guide groove of the cam member.

* * * * *